US007397490B2

(12) United States Patent
Kikuchi et al.

(10) Patent No.: US 7,397,490 B2
(45) Date of Patent: Jul. 8, 2008

(54) IMAGE FORMING APPARATUS AND METHOD

(75) Inventors: Hiroshi Kikuchi, Kanagawa (JP); Masahide Maruyama, Kanagawa (JP); Yumi Kawamoto, Kanagawa (JP); Masanobu Hida, Kanagawa (JP)

(73) Assignee: Sony Corporation, Tokyo (JP)

( * ) Notice: Subject to any disclaimer, the term of this patent is extended or adjusted under 35 U.S.C. 154(b) by 141 days.

(21) Appl. No.: 11/531,306

(22) Filed: Sep. 13, 2006

(65) Prior Publication Data

US 2007/0064084 A1 Mar. 22, 2007

(30) Foreign Application Priority Data

Sep. 16, 2005 (JP) ..... P2005-270913

(51) Int. Cl.
*B41J 25/304* (2006.01)

(52) U.S. Cl. ..... 347/198

(58) Field of Classification Search ..... None
See application file for complete search history.

(56) References Cited

U.S. PATENT DOCUMENTS 5,999,205 A 12/1999 Taguchi
6,788,326 B2 * 9/2004 Sasaki ..... 347/198
6,791,591 B2 * 9/2004 Conwell et al. ..... 347/198

FOREIGN PATENT DOCUMENTS

EP 1 484 184 12/2004
GB 2 348 509 10/2000

OTHER PUBLICATIONS

European Search Report dated Dec. 18, 2007.

* cited by examiner

*Primary Examiner*—K. Feggins
(74) *Attorney, Agent, or Firm*—Sonnenschein Nath & Rosenthal LLP

(57) ABSTRACT

An image is formed by thermally transferring dyes of a thermal transfer sheet onto a print recording medium, and then a protection layer is formed on the formed image. The transport speed of the print recording medium in the event of thermal transferring the dyes onto the print recording medium is set higher than that in the event of thermal transferring the protection layer onto the print recording medium. Thereby, the amount of thermal energy for application in the event of protection layer formation is increased to be greater than that in the event of image formation. Thereby, occurrence of concave-convex portions formed on the printed surface in association with a density difference in the event of image formation is prevented, and concurrently, the surface pattern in the event of image protection layer formation is improved.

9 Claims, 6 Drawing Sheets

IMAGE FORMING APPARATUS AND METHOD

CROSS REFERENCES TO RELATED APPLICATIONS

The present invention contains subject matter related to Japanese Patent Application JP 2005-270913 filed in the Japanese Patent Office on Sep. 16, 2005,the entire contents of which being incorporated herein by reference.

BACKGROUND OF THE INVENTION

1. Field of the Invention

The present invention relates to an image forming apparatus and method for performing image formation and lamination of a protection layer on an image to protect the image formed on a print recording medium.

2. Description of the Related Art

Image forming apparatuses include those of a sublimation type in which color materials, such as dyes, of a thermal transfer sheet are transferred onto a print recording medium to thereby form an image on the medium. In an apparatus of this type, a transparent protection layer is additionally formed on an image to protect the image formed on the print recording medium. The protection layer has functions of, for example, shielding an image from gases potentially causing image deterioration, preventing the image from discoloration associated with absorption of UV light, preventing image-forming color materials, such as dyes, from being transferred to an article including various plasticizers, such as erasing rubber, preventing the image from frictional wear, and protecting the image from sebum.

Such a protection layer is provided by being laminated on, for example, a film-shaped base material, and is thermally transferred thereonto by a thermal head. In addition to the image protection capability, the protection layer thus thermally transferred onto the image is able to prevent curling of the print recording medium. Further, depending on the case, in the event of thermal transfer being performed by using the thermal head, thermal energy incoming from the thermal head is arbitrarily varied. In this case, a small concave-convex pattern is formed with the protection layer on the surface of the medium, and the surface is arbitrarily treated to form a silky pattern, mat pattern, or lustrous pattern.

However, problems such as described below can occur when performing the surface treatment of the image during image formation and protection film lamination. In the event of image formation, concave portions occur on a printed surface in a high density print region such as dark color region. Thereby, cases can take place in which concave-convex portions corresponding to the gradation level of the image mixedly occur in the print region to the extent of degrading quality of the printed surface. This problem can possibly provide adverse effects on print quality after the protection layer is formed on the image. More specifically, in a portion where concave portions attributed to the high density print region have occurred, the concave portions affect the surface pattern of the protection layer, which is formed in the subsequent stage, to be nonuniform. As such, in the event of the surface treatment of the protection layer, also the profile of a small concave-convex pattern formed by the surface treatment becomes nonuniform, thereby degrading quality of the printed surface.

The image forming apparatuses of the above-described type include those that implement high speed printing by increasing a travel speed of a print recording medium to a highest possible level. In this case, the travel speed of the print recording medium is increased to the highest possible level not only in the event of image formation, but also in the event of protection layer formation. As such, depending on the case, compared to the past or existing techniques in which a transport speed of the print recording medium is not increased, the time period for application of pressure and thermal energy to the protection layer is shorter, thereby causing the profile of the small concave-convex pattern formed after image protection layer transfer to be unclear.

REFERENCE PUBLICATIONS/DOCUMENTS

JP-A Nos. 1985-204397, 1984-76298,and 1995-52428; and

JP-A1-WO97/039898

SUMMARY OF THE INVENTION

The present invention is made in view of problems as described above, and it is desirous to provide an image forming apparatus and method that restrain concave-convex portions to occur on a printed surface in association with a density difference during image formation and that improves a surface treated pattern during image protection layer formation, thereby improve image quality.

An image forming apparatus according to an embodiment of the present invention includes a transport section that transports a print recording medium including a receptive layer that receives a dye(s) on a substrate having thermal plasticity; a travel section that causes travel of a thermal transfer sheet having a dye layer(s) and a protection layer formed thereon to be juxtaposed to one another; a thermal head that applies thermal energy in a state where the receptive layer of the print recording medium opposes the dye layer and protection layer of the thermal transfer sheet and that sequentially thermally transfers the dye layer and protection layer of the thermal transfer sheet onto the print recording medium; and controller that controls the transport section to vary a transport speed of the print recording medium.

An image forming method according to another embodiment of the present invention uses the apparatus described above and includes the steps of transporting a print recording medium including a receptive layer that receives a dye(s) on a substrate having thermal plasticity; causing travel of a thermal transfer sheet having a dye layer(s) and a protection layer formed thereon to be juxtaposed to one another; applying thermal energy by using a thermal head in a state where the receptive layer of the print recording medium opposes the dye layer of the thermal transfer sheet and thermally transferring the dye layer of the thermal transfer sheet onto the print recording medium to thereby form an image; and applying thermal energy by using a thermal head in a state where the formed image opposes the protection layer of the thermal transfer sheet and thermally transferring the protection layer of the thermal transfer sheet onto the formed image.

In the respective image forming apparatus and method according to the embodiments of the present invention, a transport speed of the print recording medium is controlled so that the relation of $$Dy \geqq Dx$$

is satisfied, where

Dx=a variation amount in a thickness of the print recording medium in the event of thermal transfer of the dye layer onto the receptive layer of the print recording medium, Dx being defined in accordance with an expression (1) shown below; and Dy=a variation amount in the thickness of the print recording medium in the event of thermal transfer of the protection layer of the thermal transfer sheet onto an image thermally transferred onto the receptive layer of the print recording medium, Dy being defined in accordance with an expression (2) shown below.

$$Dx=|Lb-La| \quad (1)$$

$$Dy=|Lc-La| \quad (2)$$

where

La=thickness of the print recording medium prior to image formation;

Lb=thickness of a thinnest portion of the print recording medium after image formation; and Lc=thickness of the print recording medium in the event that a minimum amount of thermal energy capable of thermally transferring the protection layer onto the print recording medium has been applied to the thermal head.

Further, in the respective image forming apparatus and method according to the embodiments of the present invention, in order to realize the relation of "Dy ≧Dx", control is carried out so that a transport speed in the event of thermal transfer of the dye layer of the thermal transfer sheet onto the print recording medium is higher than a transport speed in the event of thermal transfer of the protection layer of the thermal transfer sheet onto the image thermally transferred onto the print recording medium. Alternately, control is carried out so that a transport speed in the event of thermally transfer of the protection layer of the thermal transfer sheet onto the image thermally transferred onto the print recording medium is lower than a transport speed in the event of thermally transfer of the dye layer of the thermal transfer sheet onto the print recording medium.

According to the embodiments of the present invention, since the relation of "Dy≧Dx" is satisfied, concave-convex differences caused by thermal energy during image formation can be eliminated by thermal energy during lamination of the image protection layer. Accordingly, even when thickness reduction of the print recording medium is caused by thermal energy during lamination of the image protection layer, the concave-convex differences can be eliminated by the thermal energy during lamination of the image protection layer.

Further, according to the embodiments of the present invention, in the event of image formation, the time period for application of pressure and thermal energy to the print recording medium is reduced by setting the transport speed of the print recording medium to the high speed, compared to the case where the transport speed is set to the low speed. Thereby, concave portions of the print recording medium itself become less occurrable, and hence concave-convex portions on the recording surface can be prevented from being caused by the density difference during image formation, therefore making it possible to prevent print quality degradation.

Further, according to the embodiments of the present invention, in the event of lamination of the image protection layer, the time period for application of pressure and thermal energy to the print recording medium is increased by setting the transport speed of the print recording medium to the low speed, compared to the case where the transport speed is set to the high speed, concave portions of the print recording medium itself can easily occur. As such, the time period for application of pressure and thermal energy to the print recording medium is increased thereby to allow concave portions of the print recording medium to easily occur, whereby to secure a wide concave-portion range of the print recording medium during lamination of the image protection layer. This makes it possible to thermally press or "heat-set" concave portions formed during the image formation, whereby an even clearer surface pattern can be formed.

BRIEF DESCRIPTION OF THE DRAWINGS

In the accompanying drawings.

DETAILED DESCRIPTION OF THE PREFERRED EMBODIMENTS

Figure 1:
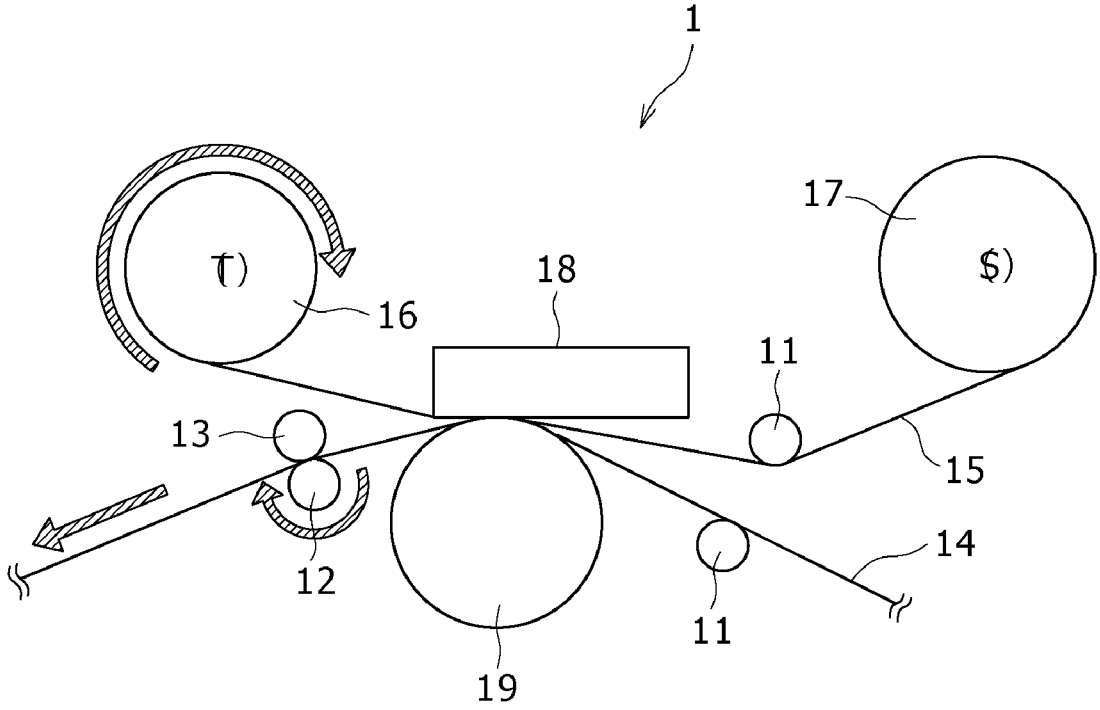
FIG. 1 is a view showing the configuration of an image forming apparatus employing an embodiment of the present invention.

A sublimation image forming apparatus 1 employing an embodiment of the present invention will be described herebelow with reference to the accompanying drawings. With reference to FIG. 1, the image forming apparatus 1 operates in the manner that, in the event of printing, a print recording medium 14, such as printing paper, is guided by a guided roller 11 and is caused to travel by being pinched between a capstan 12 and a pinch roller 13. In the image forming apparatus 1, a cartridge containing a thermal transfer sheet 15 is attached, in which a take-up reel 16 is rotated to cause the thermal transfer sheet 15 to travel from a feed reel 17 to the take-up reel 16. In a printing position where ink of the thermal transfer sheet 15 is transferred onto the print recording medium 14, a thermal head 18 and a platen roller 19 are disposed opposite one another. While the thermal transfer sheet 15 compressed at a predetermined pressure by the thermal head 18 onto the print recording medium 14, a dye is sublimated and transferred onto the print recording medium 14.

Figure 2:
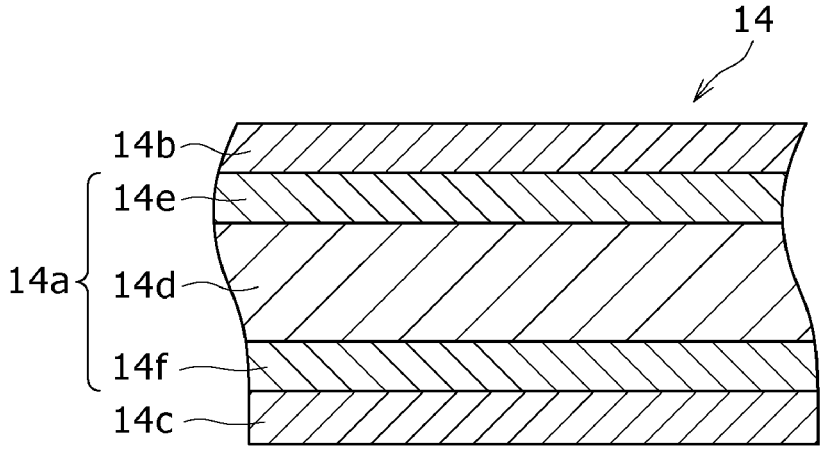
FIG. 2 is a major portion cross sectional view of a print recording medium used in the image forming apparatus employing an embodiment of the present invention.

The print recording medium 14 will be described herebelow with reference to FIG. 2. The print recording medium 14 includes a receptive layer 14*b* formed on one surface of a base material 14*a*, and a back layer 14*c* formed on the other surface of the base material 14*a*.

The base material 14*a* is formed to include resin layers 14*e* and 14*f* respectively formed on two sides of a base paper 14*d* formed of, for example, pulp. The resin layer 14*e*, 14*f* is formed of a thermoplastic resin, such as polyethylene terephthalate or polypropylene, and include a micro-void structure, thereby to have cushioning characteristics. As such, especially, the resin layer 14*e* on the side of the receptive layer 14*b* improve adhesiveness and thermal resistance between the base paper 14*d* and the receptive layer 14*b*, thereby to improve the thermal flowing capability for heat from the thermal head 18. Further, the resin layers 14*e* and 14*f* improve the engagement with the thermal head 18. Further, especially, the receptive layer 14*b* and resin layer 14*e* are formed of the thermoplastic resin, therefore having thermal deformability in response to thermal energy incoming from the thermal head 18, and the characteristic of loosing the cushioning characteristics in response to a predetermined pressure applied from the thermal head 18.

The receptive layer 14*b* has a thickness of about 1 μm to about 10 μm, receives the dye transferred from the thermal transfer sheet 15, and retains the received dye. The receptive layer 14*b* is formed of resin such as acrylic resin, polyester, polycarbonate, or polyvinyl chloride.

The back layer 14*c* reduces friction occurring with, for example, the all the guide roller 11 and the platen roller 19, to enable the print recording medium 14 to travel.

The print recording medium 14 used in the present invention is not limited in configuration to a specific type inasmuch as including the receptive layer 14*b* and the resin layer 14*e*.

Figure 3:
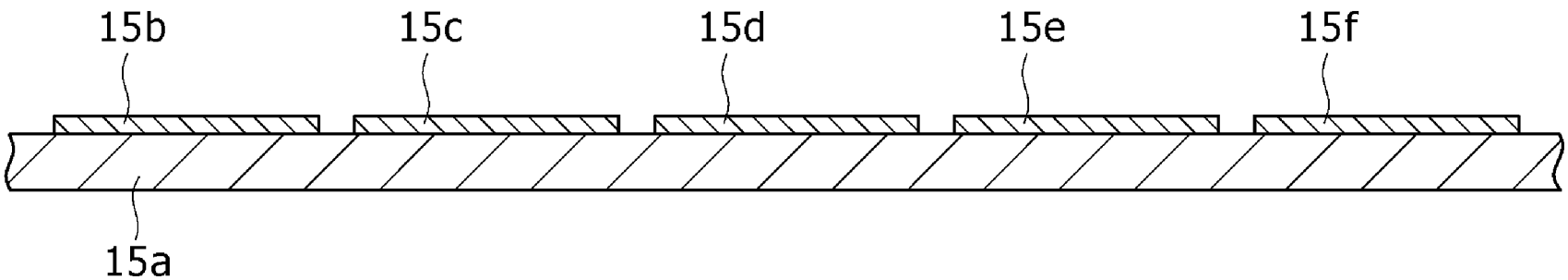
FIG. 3 is a cross sectional view showing a thermal transfer sheet used in the image forming apparatus employing an embodiment of the present invention.

With reference to FIG. 3, on the thermal transfer sheet 15, there are dye layers 15*b* to 15*e* and a protection layer 15*f* that are juxtaposed to one another in the long-side direction on one surface of a base material 15*a* formed from a synthetic resin film, such as polyester or polyethylene film. The dye layers 15*b* to 15*e* are formed from respective yellow, magenta, cyan, and black dyes for image formation and a thermoplastic resin. The protection layer 15*f* is formed from the same thermoplastic resin as that of the dye layers 15*b* to 15*e*. The dye layers 15*b* to 15*e* and the protection layer 15*f* are sequentially formed as one set in the long-side direction on the base material 15*a*. Upon receipt of thermal energy corresponding to image data from the thermal head 18, the dye layers 15*b* to 15*e* and the protection layer 15*f* are transferred to the receptive layer 14*b* of the print recording medium 14.

The thermal transfer sheet 15 used in the present invention is not limited in the configuration to a specific one inasmuch as including at least a set of one dye layer and the protection layer. For example, the thermal transfer sheet 15 can be configured of either one set of the black dye layer and the protection layer or one set of the yellow, magenta, and cyan dye layers and the protection layer.

Figure 4:
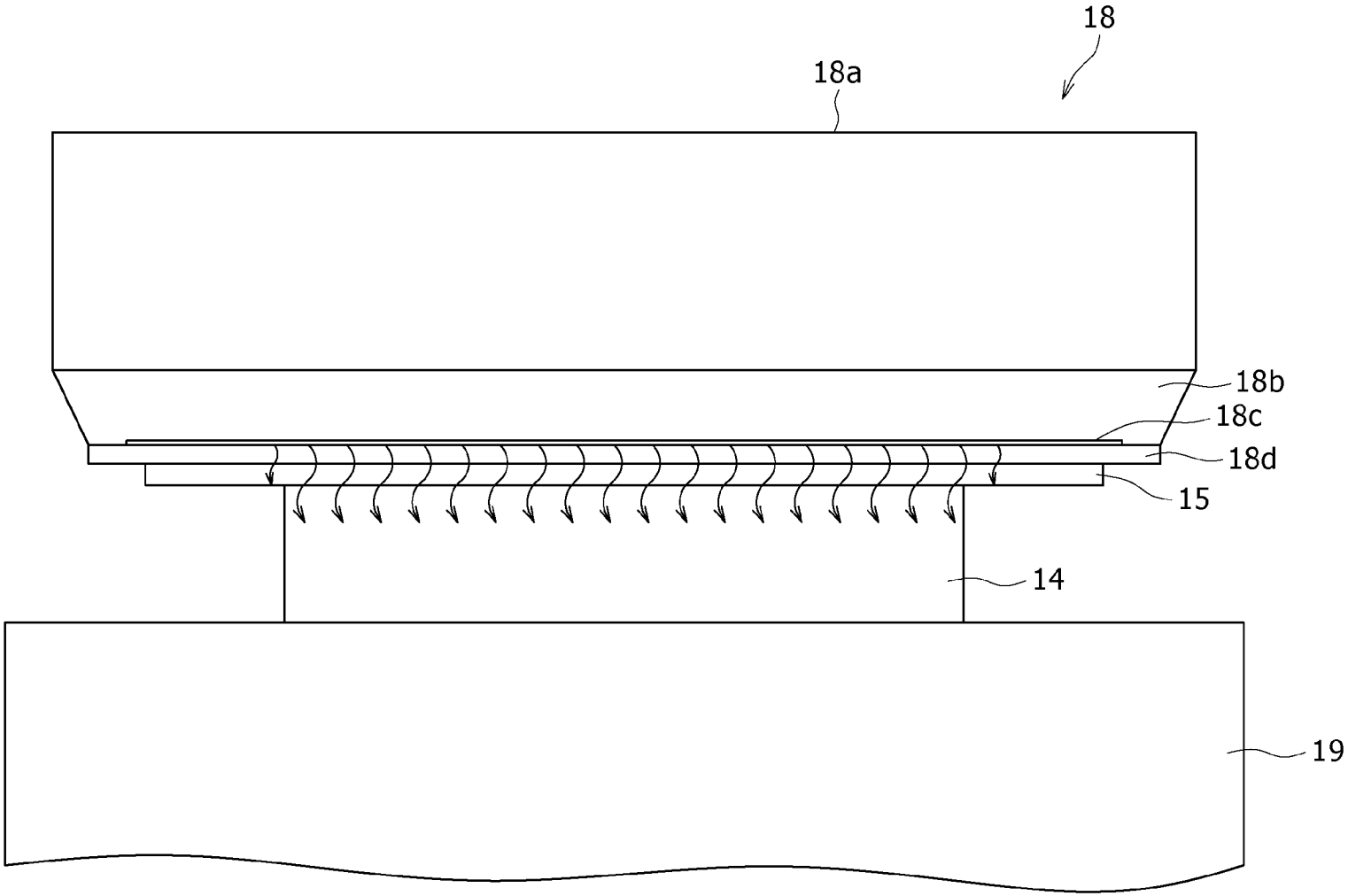
FIG. 4 is a front view showing a thermal head of the image forming apparatus employing an embodiment of the present invention.

With reference to FIG. 4, in the thermal head 18, a heater layer 18*c* formed of an exothermic element or the like is linearly provided on a ceramic substrate 18*a* via a grace layer 18*b*, and a protection layer 18*d* for protecting the heater layer 18*c* is provided thereon. The ceramic substrate 18*a* has a high heat dissipation effect and has the function of preventing heat storage in the heater layer 18*c*. The grace layer 18*b* causes the heater layer 18*c* to extend to, for example, the print recording medium 14 and the thermal transfer sheet 15, in order that the heater layer 18*c* contacts with, for example, the print recording medium 14 and the thermal transfer sheet 15. In addition, the grace layer 18*b* works as a buffer layer to prevent the heat of the heater layer 18*c* from being excessively absorbed by the ceramic layer 18*a*. The thermal head 18 operates such that the heater layer 18*c* heats the dyes of the thermal transfer sheet 15, in units of one line, which is interposed between itself and the print recording medium 14, and thereby causes the dyes to sublimate, and the dyes are then transferred onto the print recording medium 14.

Figure 5:
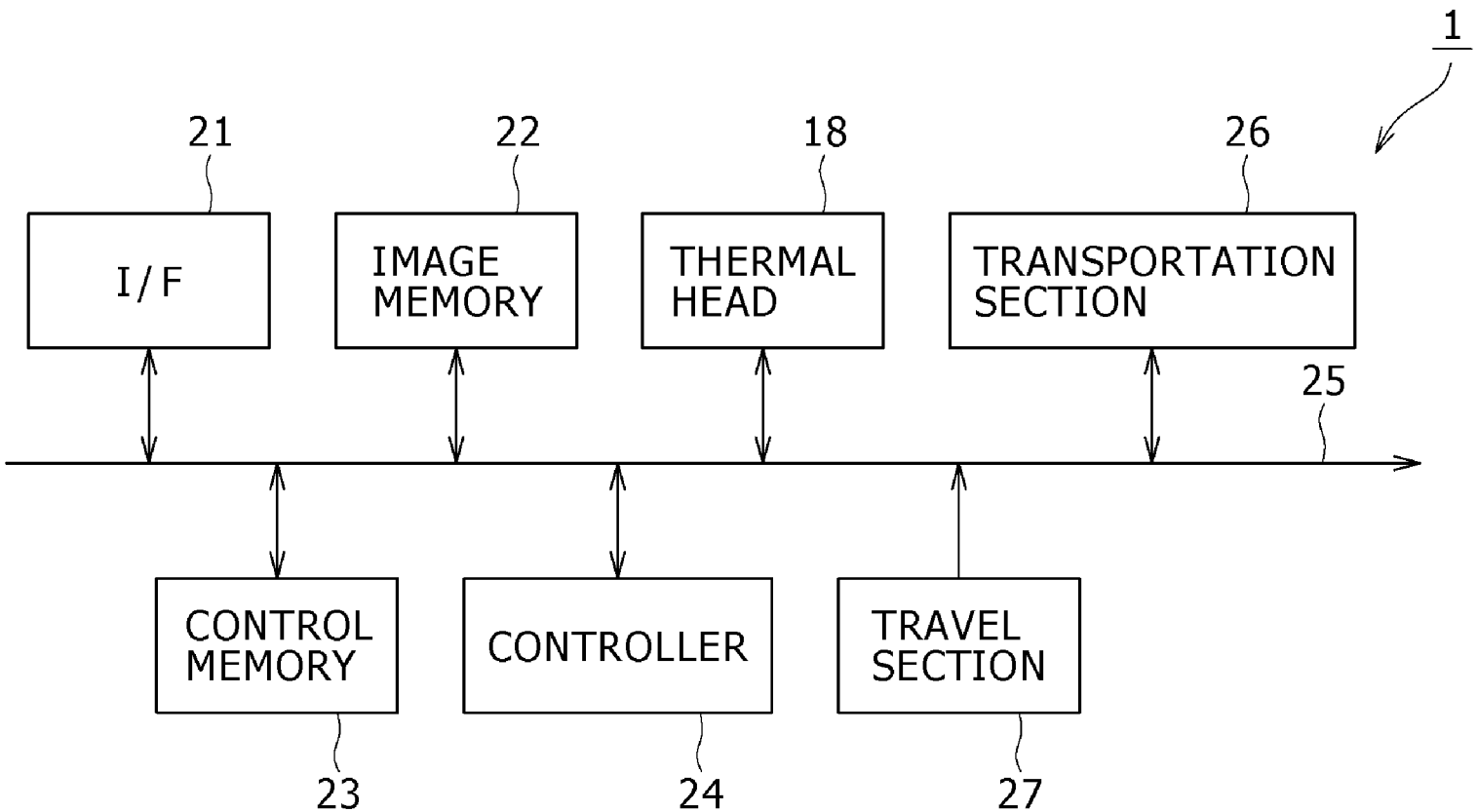
FIG. 5 is a block diagram of the image forming apparatus employing an embodiment of the present invention.

The circuit configuration of the image forming apparatus 1 thus configured will be described herebelow. With reference to FIG. 5, various components are connected to through a bus 25, as follows. The components are an interface 21 (simply "I/F 21," hereafter) that inputs printing image data; an image memory 22 that stores the image data input through the I/F 21; a control memory 23 that contains a prestored control programs; and a controller 24 that controls overall operation of components, such as the thermal head 18. Further connected to the bus 25 are, for example, a transport section 26 including, for example, the capstan 12 and a motor serving as a drive source for the capstan 12 that causes the print recording medium 14 to travel from a paper feed section to a paper ejecting section; the thermal head 18; a travel section 27 including, for example, the take-up reel 16 that causes the thermal transfer sheet 15 to travel, and a motor serving as a drive source for the take-up reel 16. Also components, such as the transport section 26 and the travel section 27 are controlled by the controller 24.

Connected to the I/F 21 are, for example, a display device, such as an LCD (liquid crystal display) or a CRT (cathode ray tube); and electric equipment such as a recording and/or playback apparatus. For example, during display of a motion image on the display device, still image data selected by a user is input. In addition, when a recording and/or playback apparatus is connected, still image data recorded in a print recording medium, such as an optical disk or IC card, is input to the I/F 21. Electric equipment is connected via cable or wirelessly to the I/F 21 in accordance with, for example, USB (universal serial bus), IEEE (the Institute of Electrical and Electronic Engineers) 1394,or Bluetooth standards.

The image memory 22 has a storage size capable of storing image data corresponding to at least one piece of paper. Printing image data having been input from the I/F 21 is input and is temporarily stored in the image memory 22. The control memory 23 contains prestored data, such as a control program for controlling the overall operation of the image forming apparatus 1. The controller 24 controls the overall operation in accordance with the control program stored in the control memory 23. For example, the controller 24 controls the transport section 26 to cause the transport speed of the print recording medium 14 to be variable, and controls the thermal head 18 corresponding to printing images.

Printing operation of the image forming apparatus 1 thus configured will be described herebelow. The controller 24 controls driving of the transport section 26 in accordance with the program stored in the control memory 23, the print recording medium 14 is transported so that a printing start position of the print recording medium 14 matches with the position of the thermal head 18. In addition, the controller 24 controls driving of the travel section 27 to cause the thermal transfer sheet 15 to travel so that thermal transfer is carried out onto the print recording medium 14 in the order of the yellow dye layer 15*b*, magenta dye layer 15*c*, cyan dye layer 15*d*, black dye layer 15*e*, and protection layer 15*f*. Then, while causing the print recording medium 14 to travel at high speed, the controller 24 drives the thermal head 18 corresponding to the printing data to thermally transfer the dye layers 15*b* to 15*e* of the thermal transfer sheet 15 in the order of yellow, magenta, cyan, and black so that the densities correspond to the image data, thereby to form an image onto the print recording medium 14. Subsequently, while the print recording medium 14 is caused to travel at a lower speed than that in the event of image formation, the protection layer 15*f* is thermally transferred onto the image.

Then, the controller 24 provides control so that printing is performed in accordance with the control program stored in the control memory 23.

More specific description will be provided hereinbelow with reference to FIG. 6. The controller 24 controls the transport speed of the print recording medium 14 so that the relation of $$Dy \geqq Dx$$

is satisfied, where

Dx is variation amount in the thickness of the print recording medium 14 in the event of thermal transfer of the yellow, magenta, cyan, and black dye layers 15*b* to 15*e* of the thermal transfer sheet 15 onto the receptive layer 14*b* of the print recording medium 14, Dx being defined in accordance with an expression (1) shown below; and Dy is a variation amount in the thickness of the print recording medium 14 in the event of thermal transfer of the protection layer 15*f* of the thermal transfer sheet 15 onto the image thermally transferred onto the receptive layer 14*b* of the print recording medium 14, Dy being defined in accordance with an expression (2) shown below.

$$Dx=|Lb-La| \quad (1)$$

$$Dy=|Lc-La| \quad (2)$$

In these expressions,

La=Thickness (μm) of the print recording medium 14 prior to image formation;

Lb=Thickness (μm) of a thinnest portion of the print recording medium 14 after image formation; and Lc=Thickness (μm) of the print recording medium 14 in the event that a minimum amount of thermal energy capable of thermally transferring the protection layer 15*f* onto the print recording medium 14 has been applied to the thermal head 18.

Thus, in the event of image formation, the controller 24 provides control to reduce the time period for application of pressure by the thermal head 18 onto the print recording medium 14, thereby to restrain occurrence of concave-convex portions on a printed surface, especially in a high density print region. More specifically, the controller 24 provides control such that, in comparison to the past or existing related techniques, in the event of image formation, the transport speed of the print recording medium 14 is increased, and the time period for application of pressure and thermal energy by the thermal head 18 onto the print recording medium 14 is reduced. In addition, the controller 24 provides control such that, when forming the protection layer 15*f*, the transport speed of the print recording medium 14 is set lower than that in the event of image formation, and the time period for application of pressure and thermal energy by the thermal head 18 onto the print recording medium 14 is increased. Thereby, a wide concave-portion range of the print recording medium 14 is secured, and concave portions formed during the image formation can be thermally pressed or "heat-set," whereby a small concave-convex pattern, such as silky pattern, mat pattern, or lustrous pattern, formed by the surface treatment can be clearly formed.

As described above, the print recording medium 14 includes the resin layer 14*e*, which has the thermoplastic micro-void structure, under the receptive layer 14*b*, in which the receptive layer 14*b* and the resin layer 14*e* is plastically deformed in response to thermal energy applied by the thermal head 18 under the predetermined pressure being applied by the thermal head 18, whereby the receptive layer 14*b* and 14*e* are squashed to be thin. In the event of image formation, utilizing this phenomenon of the print recording medium 14, the controller 24 provides control to reduce the time period for application of pressure and thermal energy by the thermal head 18 onto the print recording medium 14, thereby to reduce the squash amount of the print recording medium 14. In addition, in the event of forming the protection layer 15*f*, the controller 24 provides control such that the print recording medium 14 is again squashed by the pressure applied by the thermal head 18, whereby the transport speed of the print recording medium 14 is set lower than that in the event of image formation. In this manner, the printed surface pattern is improved.

The above will be described in accordance with the printing operation of the image forming apparatus 1. In the event of thermal transfer of the yellow, magenta, cyan, and black dye layers 15*b* to 15*e* of the thermal transfer sheet 15 onto the receptive layer 14*b*, the controller 24 provides control such that the thermal energy being applied to the print recording medium 14 and the transport speed of the print recording medium 14 are reduced to thereby cause the variation amount in the thickness of the print recording medium 14 to become Dx defined by the above-described expression (1). As such, compared to the case where the transport speed of the print recording medium 14 is low, concave portions of the print recording medium 14 itself can be controlled to be less occurrable, and concave-convex portions of the printed surface associated with density differences can be prevented or reduced in size. Consequently, the control makes it possible to prevent print quality degradation. Further, the control makes it possible to widely set the variation range of concave portions of the print recording medium 14.

Subsequently, in the event of transfer of the protection layer 15*f* onto the image formed on the print recording medium 14, the controller 24 provides control such that the transport speed of the print recording medium 14 is reduced and the time period for application of pressure by the thermal head 18 onto the print recording medium 14 is increased to cause the variation amount in the thickness of the print recording medium 14 to become Dx defined by the above-described expression (2). The control is thus provided to satisfy the relation of "Dy≧Dx". As such, compared to the case where the transport speed of the print recording medium 14 is high, concave portions of the print recording medium 14 itself are likely to occur, and the variation range of concave portions can be widely set. Thereby, for example, concave-convex portions occurred during image formation can be eliminated and arbitrary small concave-convex patterns during lamination of the protection layer 15*f*.

As described above, in the image forming apparatus 1 employing an embodiment of the present invention, the travel speed of the print recording medium 14 is variable between the event of image formation and the in the event of transfer of the protection layer 15*f*, thereby to control the thickness variation amount. The relation between the transport speed of the print recording medium 14 and the variation amount in the thickness of the print recording medium 14 was verified by performing experimentation, as described herebelow.

Printer used: UP-DR150 (brand of Sony Corporation)

Dot density: 334 dpi (corresponds to 13.15 dots/mm)

Type of print recording medium: CK9046 dedicated paper (supplied by Mitsubishi Electric Corporation)

Transport speed of print recording medium

High speed event: 0.7 msec/line=10.54 cm/sec

Low speed event: 4 msec/line=1.85 cm/sec

Application conditions of thermal energy (amount):

Black gradation images by yellow, magenta, and cyan were created (there totally exist 16 steps of 1st, 2nd, . . . , 15th, and 16th gradation levels). The amount of thermal energy was increased from the 1st gradation level to the 16th gradation level. Numeral 0 on the horizontal axis corresponds to a white base for which print processing is not performed). In this case, the strobe pulsewidth in a low transport speed (4 msec/line) event was adjusted at the respective gradation level so that the same record density characteristic as that in the vent of a high transport speed (0.7 msec/line) is exhibited. FIG. 6 is a diagram showing behaviors in the case that n (gradation level during printing) is plotted on the horizontal axis, and Dn (thickness variation amount of the recording medium in units of each print concentration gradation level=amount of squashing of the recording medium) is plotted on the vertical axis.

In this case, Dn was obtained from the following expression:

$$Dn=Ln-L0,$$

where Ln represents the thickness of the print recording medium at the an n-th gradation level, and n represents any one of integers 0 to 16. L0 corresponding to the 0th gradation level represents a thickness of a portion corresponding to the white base of the print recording medium for which the print processing is not performed. A negative value of Dn indicates the occurrence of a thickness reduction, and a positive value of Dn indicates the occurrence of a thickness increase.

The 7th or higher gradation levels are a thermal energy region capable of transferring the protection layer 15*f*. An yellow heat application energy profile was used for transfer of the protection layer 15*f*. In addition, with a gradation level portion (7th gradation level) set to a boundary at which transfer of the image protection layer 15*f* shifts becomes an impossible (non-transferable) state from a possible (transferable) state, the low gradation level side and the high gradation level side are defined to be an "image protection layer non-transferable energy region" and an "image protection layer transferable energy region," respectively.

Figure 6:
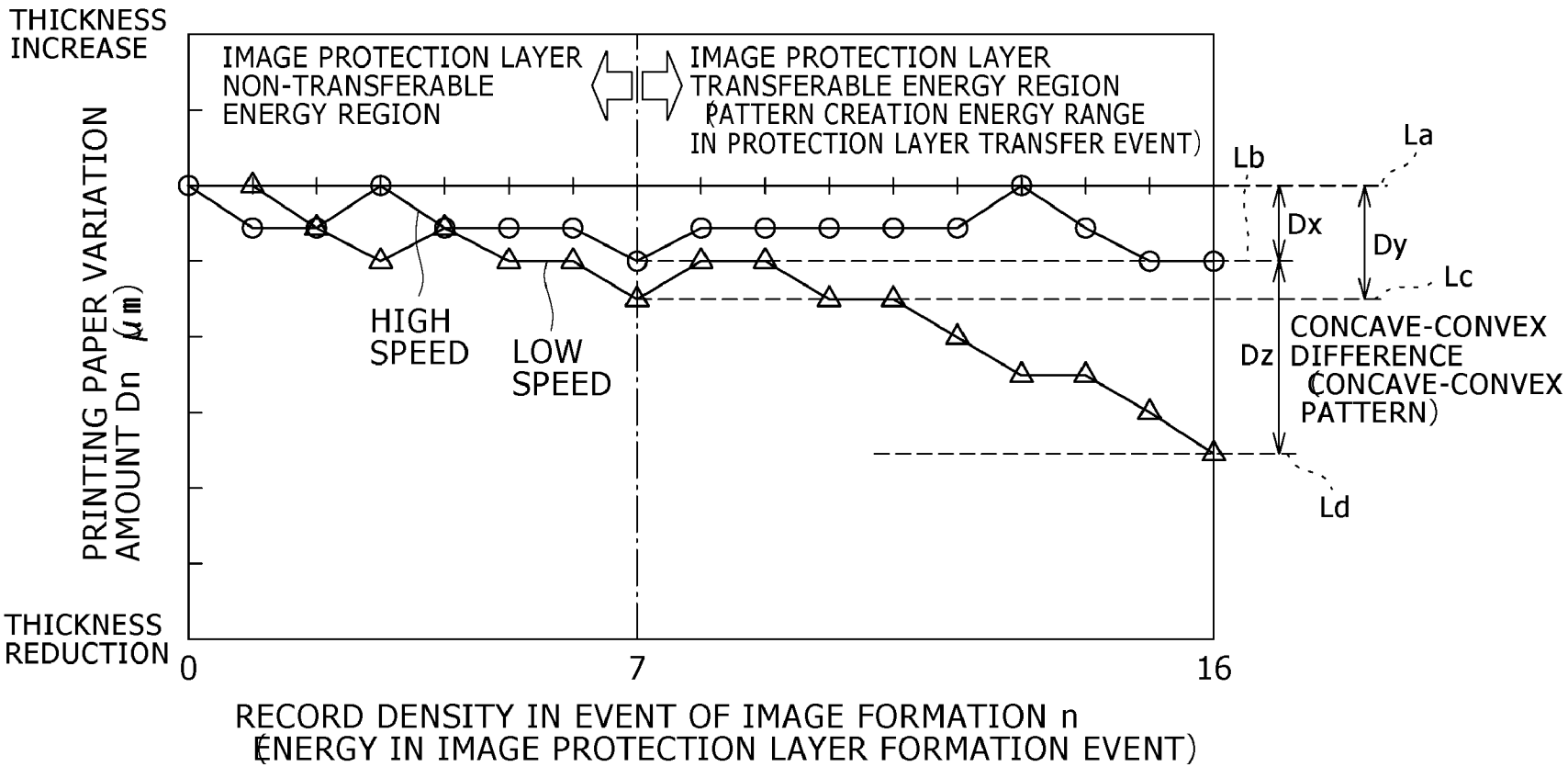
FIG. 6 is a diagram showing behaviors in the case that n (gradation level during printing) is plotted on the horizontal axis, and Dn (thickness variation amount of the print recording medium in units of each print density gradation level=squash amount of the print recording medium) is plotted on the vertical axis.

From FIG. 6, the following can be known. Let us refer to the case of the conditions set so that the record density characteristic of the print recording medium 14 and the image protection layer transferable energy region are the same. In this case, it can be known that as the transport speed of the print recording medium 14 is increased, the thickness variation amount Dn can be reduced; and conversely, as the transport speed of the print recording medium 14 is reduced, the thickness variation amount Dn can be increased. In addition, let us refer to the case where the transport speed of the print recording medium 14 is differentiated, and the conditions are set so that the record density characteristic of the print recording medium 14 and the image protection layer transferable energy region are the same. In this case, it can be known that, when recording is performed at the high transport speed, the thickness variation amount Dn of the print recording medium 14 is less than that in the event of printing performed at the low transport speed. This is attributed to the fact that the time period for application of thermal energy by the thermal head 18 onto the print recording medium 14 is reduced. It can be further known that, in the event of printing performed at the low transport speed, the thickness reduction amount of the print recording medium 14 is greater, compared to the case of printing performed at the high transport speed. This is attributed to the fact that the time period for application of pressure and thermal energy by the thermal head 18 onto the print recording medium 14 is increased.

Figure 7:
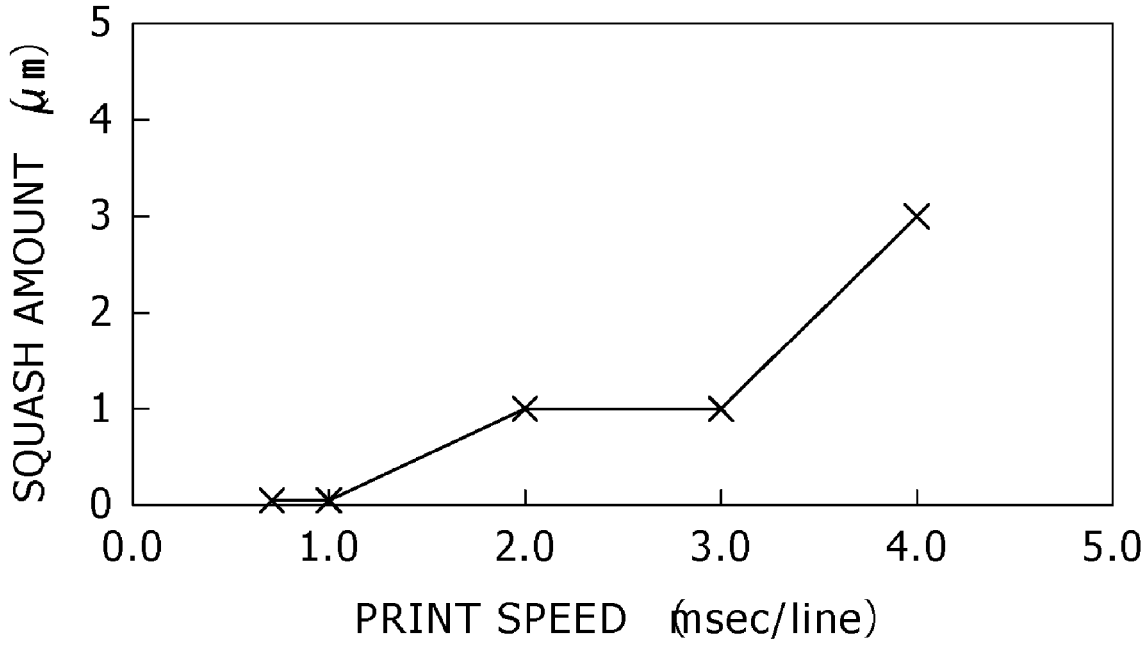
FIG. 7 is a view showing the relationship between a print speed and the squash amount of the print recording medium.

FIG. 7 is a view showing the relationship between the print speed and the squash amount of the print recording medium 14. In the present examination, the yellow heat application energy profile in the event of image formation was used, and a chromatic density at the respective speed was set to be constant. More specifically, as viewed from the print recording medium 14, the amount of thermal energy was set to be constant. In addition, the squash amount was represented by an absolute value, as defined by an expression shown below.

Squash amount=|thickness of post-image-formation print recording medium 14−thickness of pre-image-formation print recording medium 14|

From FIG. 7 as well, it can be verified that the lower the print speed, that is, the lower the transport speed of the print recording medium 14 is, the greater the squash amount is, and the higher the transport speed of the print recording medium 14 is, the smaller the squash amount is.

In the image forming apparatus 1 employing an embodiment of the present invention, utilizing the above-described phenomenon, the squash amount of the print recording medium 14 is reduced by transferring the print recording medium 14 at the high speed in event of image formation, and the squash amount of the print recording medium 14 is increased by transferring the print recording medium 14 at the low speed in the event of forming the protection layer, whereby the relation of "Dy≧Dx" is satisfied.

Then, a print was formed under the conditions described above. In the experimental operation, observation was focused on the surface pattern of the print formed in the case where the transport conditions for image formation and protection layer lamination are differentiated to 0.7 msec/line (high speed) and 4 msec/line (low speed). As data in the event of image formation, standard image data (complying with JIS SCID (Standard Color Image Data) No. 1) was used. In addition, in the event of protection layer lamination, while the thermal energy being applied by the thermal head 18 was being modulated into a rectangular shape resulting in that the distortion amount of the print recording medium falls in the range of Dy to Dz, a respective protection film was laminated to have a concave/convex surface pattern. The results are shown in Table 1 given below.

Dz is defined in accordance with expression (3) shown below, and represents a concave-convex difference in the surface treatment for forming silky, mat, or lustrous patterns on the protection layer 15*f*, for example. The concave-convex difference can be formed by shifting of the amount of thermal energy in the image protection layer non-transferable energy region shown in FIG. 6. However, the surface treatment is not indispensable in the present invention.

$$Dz=Ld-Lc \quad (3)$$

In the expression,

Ld=thickness (μm) of a minimum thickness portion of the print recording medium 14 in the event that the thermal transfer sheet 15 is formed on the print recording medium 14 in the thermally-transferable range.

As above, the above embodiment and examples have been described with reference to the cases where image formation is performed at the high speed and protection layer formation is performed at the low speed. However, the respective speeds are just examples, and the present invention is not limited to the examples described above.

It should be understood by those skilled in the art that various modifications, combinations, sub-combinations and alterations may occur depending on design requirements and other factors insofar as they are within the scope of the appended claims or the equivalents thereof.

TABLE 1

| | Transport Condition (Msec/Line) for Image Formation | Transport Condition (Msec/Line) for Protection Layer Lamination | Uniformity of Concave-Convex Profile after Protection Layer Lamination | Clearness of Concave-Convex Profile | Total Determination |
|---|---|---|---|---|---|
| Embodiment | 0.7 (High Speed) | 0.4 (Low Speed) | ○ | ○ | ○ |
| Comparative Example 1 | 0.7 (High Speed) | 0.7 (High Speed) | ○ | X | X |
| Comparative Example 2 | 0.4 (Low Speed) | 0.4 (Low Speed) | X | ○ | X |
| Comparative Example 3 | 0.4 (Low Speed) | 0.7 (High Speed) | X | X | X |

Uniformity of Concave-Convex Profile after Protection Layer Lamination
○: Concave-convex profiles are uniform in the overall region of the printed surface; and
X: Concave-convex profiles are incomplete in the high density region, such that concave-convex profiles in the overall region of the printed surface are nonuniform.
Clearness of Concave-Convex Profile
○: Concave-convex profiles are clear; and
X: Concave-convex profiles are unclear.
Total Determination
○: Concave-convex profiles are uniform in the overall region of the printed surface, and are clear; and
X: Concave-convex profiles are nonuniform and unclear in the overall region of an unclear printed surface.

In Table 1,the embodiment employs the present invention, from which it can be verified that good results can be obtained both in the uniformity and clearness of concave-convex profile after protection film lamination.

In comparative example 1,the print recording medium 14 is transported at the high speed during the image formation and protection film lamination. As such, in comparative example 1,since protection film lamination is performed at the high speed, a sufficient distortion time period cannot be secured. Consequently, concave-convex portions occurred during image formation cannot be completely eliminated, such that good results cannot be obtained in clearness of concave-convex profile in the clearness after protection film lamination.

In comparative example 2,the print recording medium 14 is transported at the low speed during the image formation and protection film lamination. As such, in comparative example 2,protection film lamination is performed at the low speed and hence thermal energy is excessively applied by the thermal head 18. Thereby, the print recording medium 14 is formed in a completely squashed state or a state similar thereto, such that good results cannot be obtained in uniformity of concave-convex profile in the clearness after protection film lamination.

Conversely to the embodiment, in comparative example 3,image formation is performed at the low speed, and protection film lamination is performed at the high speed. Consequently, in comparative example 3,good results cannot be obtained both in the uniformity and clearness of concave-convex profile after protection film lamination.

What is claimed is:

1. An image forming apparatus, comprising:

transport means that transports a print recording medium including a receptive layer that receives a dye(s) on a substrate having thermal plasticity;

travel means that causes travel of a thermal transfer sheet having a dye layer(s) and a protection layer formed thereon to be juxtaposed to one another;

a thermal head that applies thermal energy in a state where the receptive layer of the print recording medium opposes the dye layer and protection layer of the thermal transfer sheet and that sequentially thermally transfers the dye layer and protection layer of the thermal transfer sheet onto the print recording medium; and control means that controls the transport means to vary a transport speed of the print recording medium, wherein the control means controls the transport speed of the print recording medium so that the relation of $$Dy \geqq Dx$$

is satisfied, where

Dx=a variation amount in a thickness of the print recording medium in the event of thermal transfer of the dye layer onto the receptive layer of the print recording medium, Dx being defined in accordance with an expression (1); and Dy=a variation amount in the thickness of the print recording medium in the event of thermal transfer of the protection layer of the thermal transfer sheet onto an image thermally transferred onto the receptive layer of the print recording medium, Dy being defined in accordance with an expression (2), the expressions (1) and (2) being $$Dx=|Lb-La| \quad (1) \text{ and}$$

$$Dy=|Lc-La| \quad (2),$$

where

La=thickness of the print recording medium prior to image formation;

Lb=thickness of a thinnest portion of the print recording medium after image formation; and Lc=thickness of the print recording medium in the event that a minimum amount of thermal energy capable of thermally transferring the protection layer onto the print recording medium has been applied to the thermal head.

2. An image forming apparatus according to claim 1, wherein a base material of the print recording medium contains micro-voids.

3. An image forming apparatus according to claim 1, wherein the control means controls the transport means so that a transport speed in the event of thermal transfer of the dye layer of the thermal transfer sheet onto the print recording medium is higher than a transport speed in the event of thermal transfer of the protection layer of the thermal transfer sheet onto the image thermally transferred onto the print recording medium.

4. An image forming apparatus according to claim 1, wherein the control means controls the transport means so that a transport speed in the event of thermal transfer of the protection layer of the thermal transfer sheet onto the image thermally transferred onto the print recording medium is lower than a transport speed in the event of thermal transfer of the dye layer of the thermal transfer sheet onto the print recording medium.

5. An image forming method, comprising the steps of:

transporting a print recording medium including a receptive layer that receives a dye(s) on a substrate having thermal plasticity;

causing travel of a thermal transfer sheet having a dye layer(s) and a protection layer formed thereon to be juxtaposed to one another;

applying thermal energy by using a thermal head in a state where the receptive layer of the print recording medium opposes the dye layer of the thermal transfer sheet and thermally transferring the dye layer of the thermal transfer sheet onto the print recording medium to thereby form an image; and applying thermal energy by using a thermal head in a state where the formed image opposes the protection layer of the thermal transfer sheet and thermally transferring the protection layer of the thermal transfer sheet onto the formed image, wherein a transport speed of the print recording medium is controlled so that the relation of $$Dy \geqq Dx$$

is satisfied, where

Dx=a variation amount in a thickness of the print recording medium in the event of thermal transfer of the dye layer onto the receptive layer of the print recording medium, Dx being defined in accordance with an expression (1); and Dy=a variation amount in the thickness of the print recording medium in the event of thermal transfer of the protection layer of the thermal transfer sheet onto an image thermally transferred onto the receptive layer of the print recording medium, Dy being defined in accordance with an expression (2), the expressions (1) and (2) being $$Dx=|Lb-La| \quad (1) \text{ and}$$

$$Dy=|Lc-La| \quad (2),$$

where

La=thickness of the print recording medium prior to image formation;

Lb=thickness of a thinnest portion of the print recording medium after image formation; and Lc=thickness of the print recording medium in the event that a minimum amount of thermal energy capable of thermally transferring the protection layer onto the print recording medium has been applied to the thermal head.

6. An image forming apparatus, comprising:

transport section that transports a print recording medium including a receptive layer that receives a dye(s) on a substrate having thermal plasticity;

travel section that causes travel of a thermal transfer sheet having a dye layer(s) and a protection layer formed thereon to be juxtaposed to one another;

a thermal head that applies thermal energy in a state where the receptive layer of the print recording medium opposes the dye layer and protection layer of the thermal transfer sheet and that sequentially thermally transfers the dye layer and protection layer of the thermal transfer sheet onto the print recording medium; and controller that controls the transport section to vary a transport speed of the print recording medium, wherein the controller controls the transport speed of the print recording medium so that the relation of $$Dy \geqq Dx$$

is satisfied, where

Dx=a variation amount in a thickness of the print recording medium in the event of thermal transfer of the dye layer onto the receptive layer of the print recording medium, Dx being defined in accordance with an expression (1); and Dy=a variation amount in the thickness of the print recording medium in the event of thermal transfer of the protection layer of the thermal transfer sheet onto an image thermally transferred onto the receptive layer of the print recording medium, Dy being defined in accordance with an expression (2), the expressions (1) and (2) being $$Dx=|Lb-La| \quad (1) \text{ and}$$

$$Dy=|Lc-La| \quad (2),$$

where

La=thickness of the print recording medium prior to image formation;

Lb=thickness of a thinnest portion of the print recording medium after image formation; and Lc=thickness of the print recording medium in the event that a minimum amount of thermal energy capable of thermally transferring the protection layer onto the print recording medium has been applied to the thermal head.

7. An image forming apparatus according to claim 6, wherein a base material of the print recording medium contains micro-voids.

8. An image forming apparatus according to claim 6, wherein the controller controls the transport section so that a transport speed in the event of thermal transfer of the dye layer of the thermal transfer sheet onto the print recording medium is higher than a transport speed in the event of thermal transfer of the protection layer of the thermal transfer sheet onto the image thermally transferred onto the print recording medium.

9. An image forming apparatus according to claim 6, wherein the controller controls the transport section so that a transport speed in the event of thermal transfer of the protection layer of the thermal transfer sheet onto the image thermally transferred onto the print recording medium is lower than a transport speed in the event of thermal transfer of the dye layer of the thermal transfer sheet onto the print recording medium.

* * * * *